US010682275B2

(12) United States Patent
Richard

(10) Patent No.: US 10,682,275 B2
(45) Date of Patent: Jun. 16, 2020

(54) PERSONAL MOBILITY DEVICE

(71) Applicant: Troy Richard, Shelbyville, TX (US)

(72) Inventor: Troy Richard, Shelbyville, TX (US)

( * ) Notice: Subject to any disclaimer, the term of this patent is extended or adjusted under 35 U.S.C. 154(b) by 433 days.

(21) Appl. No.: 15/363,846

(22) Filed: Nov. 29, 2016

(65) Prior Publication Data

US 2017/0224567 A1 Aug. 10, 2017

Related U.S. Application Data

(60) Provisional application No. 62/293,743, filed on Feb. 10, 2016.

(51) Int. Cl.
*A61G 7/10* (2006.01)

(52) U.S. Cl.
CPC ..... *A61G 7/1076* (2013.01); *A61G 7/1034* (2013.01); *A61G 7/1063* (2013.01); *A61G 7/1044* (2013.01); *A61G 7/1086* (2013.01)

(58) Field of Classification Search
CPC .. A61G 7/1046; A61G 7/1073; A61G 7/1074; A61G 7/1076; A61G 7/1034; A61G 7/1063; A61G 7/1044; A61G 7/1086
See application file for complete search history.

(56) References Cited

U.S. PATENT DOCUMENTS

| | | | | |
|---|---|---|---|---|
| 2,757,388 | A | 8/1956 | Chisholm | |
| 2,963,713 | A | 12/1960 | Forrest | |
| 2,975,435 | A | 3/1961 | Forrest | |
| 3,911,509 | A * | 10/1975 | Fleckenstein | A61G 7/1038 182/15 |
| 4,279,043 | A | 7/1981 | Saunders | |
| 4,829,612 | A | 5/1989 | Adams | |
| 4,934,003 | A | 6/1990 | Hayakawa et al. | |
| 5,054,137 | A | 10/1991 | Christensen | |
| 5,079,789 | A | 1/1992 | Jandrakovic | |
| 5,201,333 | A | 4/1993 | Shalmon et al. | |

(Continued)

FOREIGN PATENT DOCUMENTS

| | | | |
|---|---|---|---|
| FR | 2526312 | A1 | 11/1983 |
| FR | 2760187 | A1 | 9/1998 |

(Continued)

OTHER PUBLICATIONS

Allegro Medical, "Saftey Sure Transfer Pivot Disk," https://www.allegromedical.com/daily-living-aids-c519/safetysure-transfer-pivot-disc-p189367.html, Oct. 8, 2011, 4 pages.

(Continued)

*Primary Examiner* — David R Hare
*Assistant Examiner* — Alexis Felix Lopez
(74) *Attorney, Agent, or Firm* — Conley Rose, P.C.; Grant Rodolph; Robert E. Kent

(57) ABSTRACT

A personal mobility device comprising a base plate having a top surface, a rotating platform having a top surface and a bottom surface, wherein a plurality of rollers are coupled to the bottom surface of the rotating platform and configured to support the rotating platform upon the top surface of the base plate, a motor coupled to the base plate and the rotating platform and configured to rotate the rotating platform with respect to the base plate, and a support structure coupled to the rotating platform and extending upward from the top surface of the rotating platform.

17 Claims, 10 Drawing Sheets

(56) References Cited

U.S. PATENT DOCUMENTS

| | | | | |
|---|---|---|---|---|
| 5,273,063 | A | 12/1993 | Farr et al. | |
| 5,311,622 | A | 5/1994 | Allen | |
| 5,507,044 | A * | 4/1996 | Williamson | A61G 7/1019 5/507.1 |
| 5,524,303 | A | 6/1996 | Palmer, Jr. et al. | |
| 5,794,284 | A * | 8/1998 | Southwell, Jr. | A61G 7/1038 135/67 |
| 6,038,465 | A * | 3/2000 | Melton, Jr. | A61B 5/1171 600/407 |
| 6,058,527 | A | 5/2000 | Charpin | |
| 6,119,287 | A * | 9/2000 | Phillips | A61G 7/1017 5/81.1 RP |
| 6,260,218 | B1 * | 7/2001 | Tsuga | A61G 7/1019 5/86.1 |
| 6,568,646 | B2 | 5/2003 | Wess et al. | |
| 7,040,248 | B1 | 5/2006 | Whitfield | |
| 7,165,276 | B2 | 1/2007 | Hahn et al. | |
| 2005/0076436 | A1 * | 4/2005 | Hahn | A61G 7/1038 5/81.1 R |
| 2006/0162753 | A1 | 7/2006 | Grana et al. | |
| 2013/0269102 | A1 | 10/2013 | Raven | |
| 2015/0250674 | A1 * | 9/2015 | Moore | A61G 7/1044 135/65 |

FOREIGN PATENT DOCUMENTS

| | | | |
|---|---|---|---|
| FR | 2939027 | A1 | 6/2010 |
| NL | 9101616 | A | 4/1993 |
| WO | 2008022634 | A1 | 2/2008 |

OTHER PUBLICATIONS

Allegro Medical, "Standing-Sitting Turntable," https://www.allegromedical.com/daily-living-aids-c519/standing-sitting-turntable-p539396.html, Jun. 2, 2011, 3 pages.

"SafetySure Pivot Disc by Mobility Transfer System," https://web.archive.org/web/20150228122333/https://mtsmedicalsupply.com/safetysure-pivot-disc/118/SSPD, Feb. 28, 2015, 3 pages.

* cited by examiner

PERSONAL MOBILITY DEVICE

CROSS-REFERENCE TO RELATED APPLICATIONS

The present application claims priority to U.S. Provisional Patent Application 62/293,743, filed Feb. 10, 2016 by Troy Richard, and entitled "Personal Mobility Device," which is incorporated herein by reference as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

As a person ages, aspects of that person's health are often impacted to various degrees. However, that impact may not be uniform across the person's body. As a result, while a person might experience a decline in health and ability with respect to one part of the body, other parts of the body may be fully, or substantially fully, functioning. As such, a person may be reliant on other people for assistance with mobility. Having to be dependent on another person for basic mobility may result in a perceived lack of dignity, which might be mitigated in part by utilizing the functioning portion of the person's body. Therefore, aiding the person in utilizing the functioning portion of the person's body, while still providing the necessary assistance when needed, may be desirable.

SUMMARY

In one embodiment, a personal mobility device comprising a base plate having a top surface, a rotating platform having a top surface and a bottom surface, wherein a plurality of rollers are coupled to the bottom surface of the rotating platform and configured to support the rotating platform upon the top surface of the base plate, a motor coupled to the base plate and the rotating platform and configured to rotate the rotating platform with respect to the base plate, and a support structure coupled to the rotating platform and extending upward from the top surface of the rotating platform.

In another embodiment, an apparatus comprising a base plate, a rotating platform pivotally coupled to the base plate via a pivotal coupling, and a support structure coupled to the rotating platform. The support structure is configured to assist in supporting a person standing on the rotating platform. The rotating platform is configured to be rotated about the pivotal coupling from a first position to a second position.

In yet another embodiment, an apparatus comprising a rotating platform and a support structure coupled to the rotating platform. The rotating platform is configured to rotate in a circular motion to transport a person standing on the rotating platform from a first location to a second location. The support structure is configured to be usable by the person as a brace for rising to stand on the rotating platform and supporting at least a portion of a weight of the person.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1:
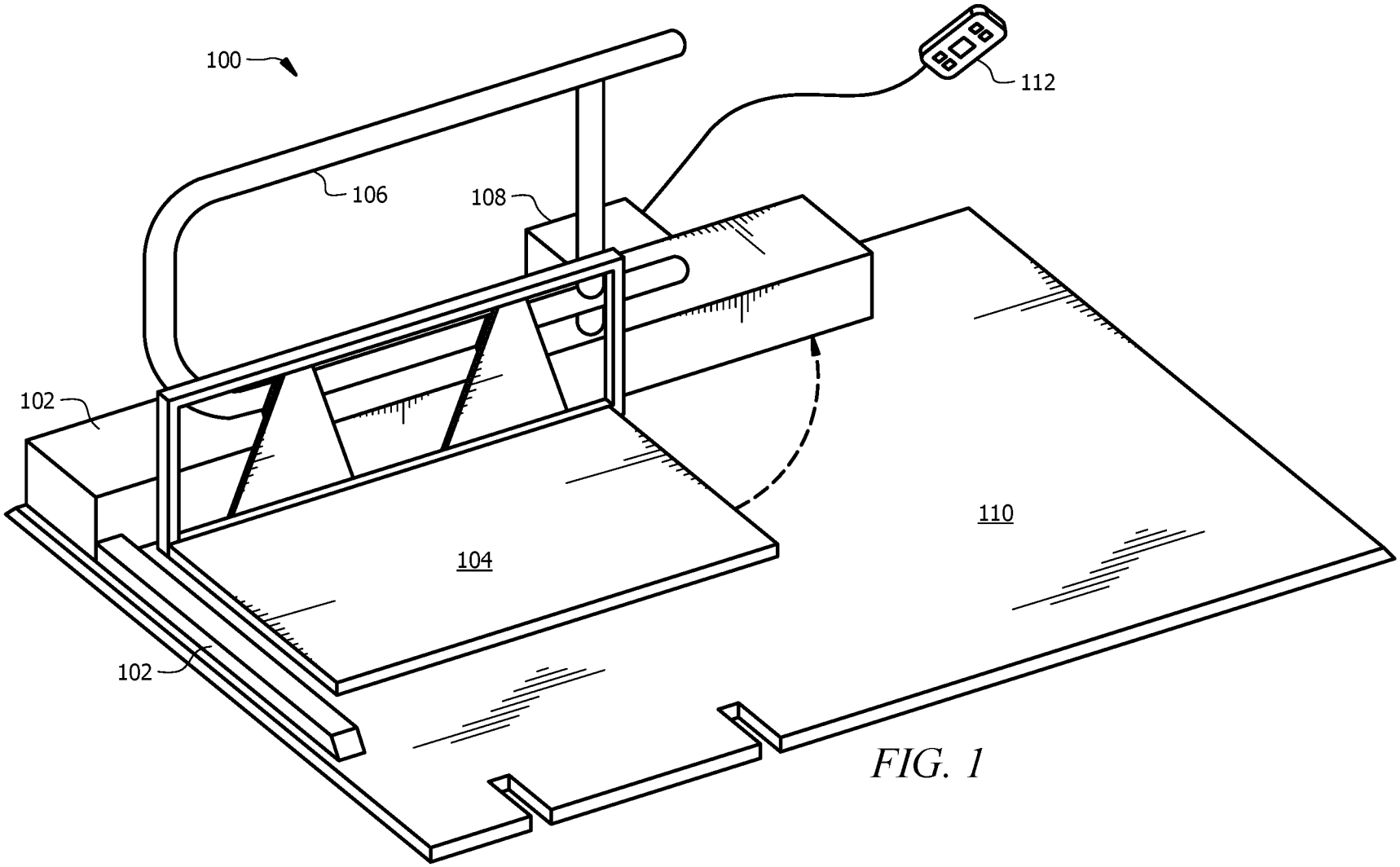
FIG. 1 is a perspective view of an embodiment of a personal mobility device in a first position.

It should be understood at the outset that although an illustrative implementation of one or more embodiments are provided below, the disclosed apparatus, systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

For a person who has limited mobility, the person may require some degree of mobility assistance while still having the physical capacity to perform some tasks independently, or substantially independently. For the purposes of this disclosure, the person who has limited mobility will be referred to as a patient, although the disclosure is applicable to any person with limited mobility and should in no way be limited to use only with a person who has received a clinical diagnosis or who is under medical care. For example, after a health event such as a heart attack, a stroke, broken bones, or other like impairments, the patient may require some mobility assistance from a caregiver, but may retain the capacity for some independent actions. A caregiver may generally refer to an individual that is helping the patient and may be a trained (e.g., medical professional) caregiver, an untrained caregiver (e.g., a family member or a friend of the patient), or any other individual who aids in the mobility of the patient. Often, the patient has few options that allow for combined independence and assistance with regard to mobility. For example, a patient in a hospital or care facility bed, a person with limited lower body strength during rehabilitation, declining lower body muscle mass, increasing age, or a person with difficulty rising from a sitting position often become wholly dependent on at least one caregiver to move because of a lack of mobility options. However, although the patient's lower body strength is insufficient to stand without assistance, the patient may have sufficient upper-body strength to rise into a standing position from a sitting position with the help of a brace.

In some circumstances, such movements occur at a risk to the caregiver's or the patient's safety. For example, when the patient is in a sitting position at home in a rocking chair, the patient may require assistance in rising to a standing position to transfer to a wheelchair or to begin movement with a walker because of a lack of lower body strength. To reach the standing position, the caregiver may physically pull the patient from the sitting position to the standing position, or the caregiver may provide his body as an anchor or brace for the patient to use as a stabilizing aid for standing. In either scenario, the caregiver risks injury or strain to himself through these actions, as well as risking injury to the patient due to the strain of being physically pulled while in a fragile state. As another example, when the patient is rehabilitating an injury, or is losing strength, but retains function, in his legs, the patient may desire to perform mobility functions himself. Accordingly, the patient may use a brace to stand and transfer from one position to another.

As a third example, when the patient is partially, or completely, bedridden, movement may be even more limited and additional complications such as changing bedsheets and hygiene of the patient are added. For example, the patient may be moved in the bed, or moved to position other than the bed, by a plurality of caregivers sliding flat, rigid body boards underneath the patient and lifting or sliding the patient into a different position before removing the body boards. Alternatively, the plurality of caregivers may physically hold the patient and move the patient by pulling, pushing, or rolling the patient to change bedsheets or address hygiene, each of which may injure the patient or the caregivers as discussed above. However, the patient might have sufficient lower body strength to stand with the help of a brace and sufficient upper body strength to pull himself into the standing position, thereby allowing a single caregiver to address needs of the patient rather than requiring a plurality of caregivers. Therefore, a flexible mobility device that aids in personal mobility and provides various degrees of independence for the patient may benefit both the patient and the caregivers by reducing physical strain on their bodies, reducing a number of caregivers required to move the patient, and allowing the patient to retain some degree of independence and personal dignity.

Disclosed herein are various embodiments that provide for a personal mobility device. The personal mobility device includes a rotatable platform and a support bar positioned such that the patient may pull himself from a sitting position into a standing position on the rotatable platform using the support bar and, while standing on the platform, support a portion of his weight on the support bar. The rotatable platform rotates through the use of a remote controlled motor, or alternatively, by being rotated manually by the caregiver, and has a plurality of positions to which it may be rotated. The patient may pull himself up from a first seated position onto the rotatable platform with the rotatable platform in a first position, the rotatable platform may be rotated from the first position to a second position, and the patient may transfer to a second seated position from the rotatable platform. Alternatively, after pulling himself up onto the rotatable platform from the first seated position, or after the rotatable platform has been rotated from the first position into the second position, the patient may support a portion of his weight on the support bar and remain in a standing position on the rotatable platform prior to returning to the first seated position. The rotatable platform, support bar, and motor are mounted to a base plate to enable efficient transportation of the personal mobility device from one location to another location, as well as stability for the personal mobility device while the patient is standing on the rotatable platform or using the support bar. To increase a level of safety of the personal mobility device while in use, various accessories may be added to the personal mobility device as needed based on particular usage scenarios.

Figure 2:
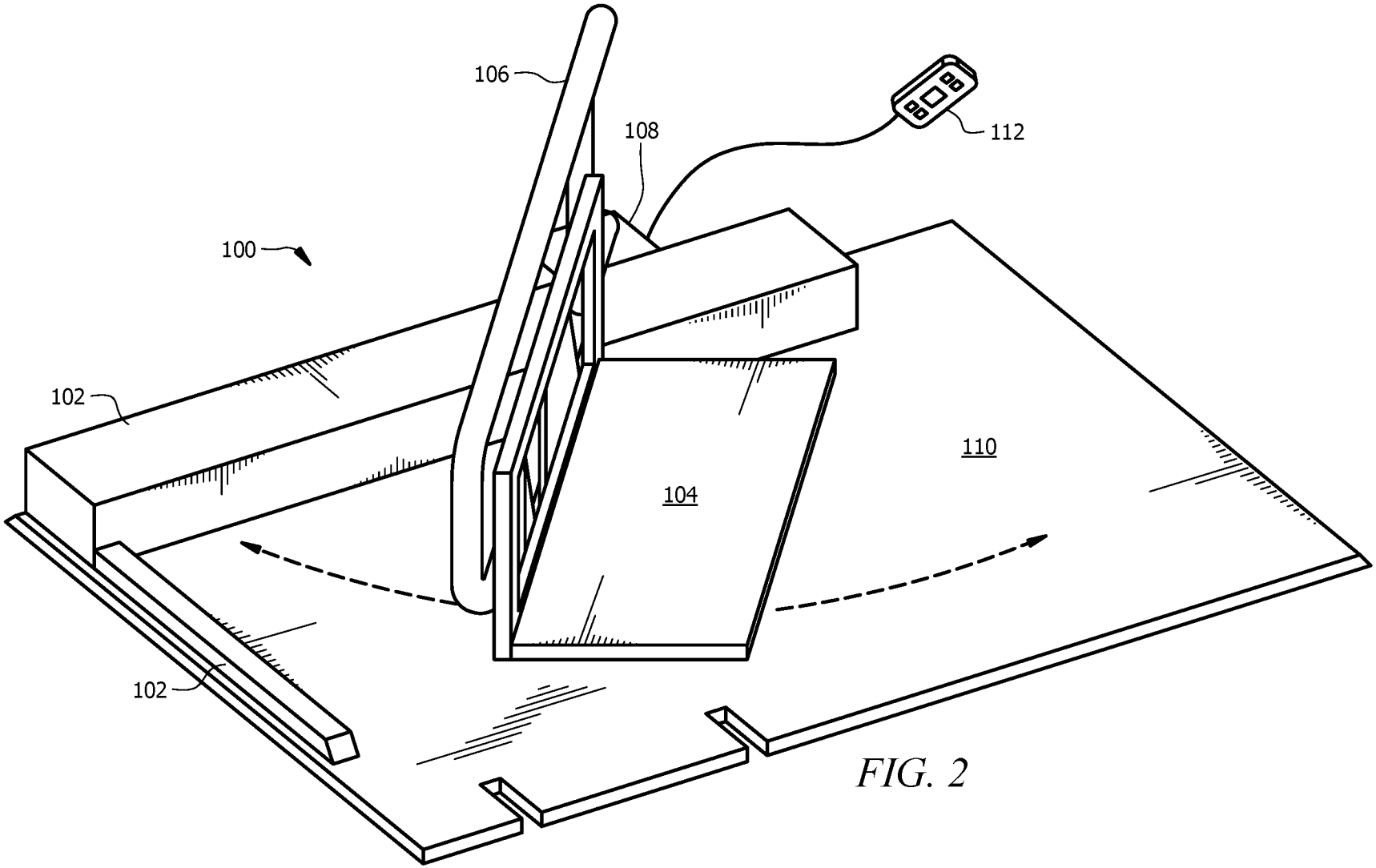
FIG. 2 is a perspective view of the embodiment of the personal mobility transitioning from the first position to a second position.
Figure 3:
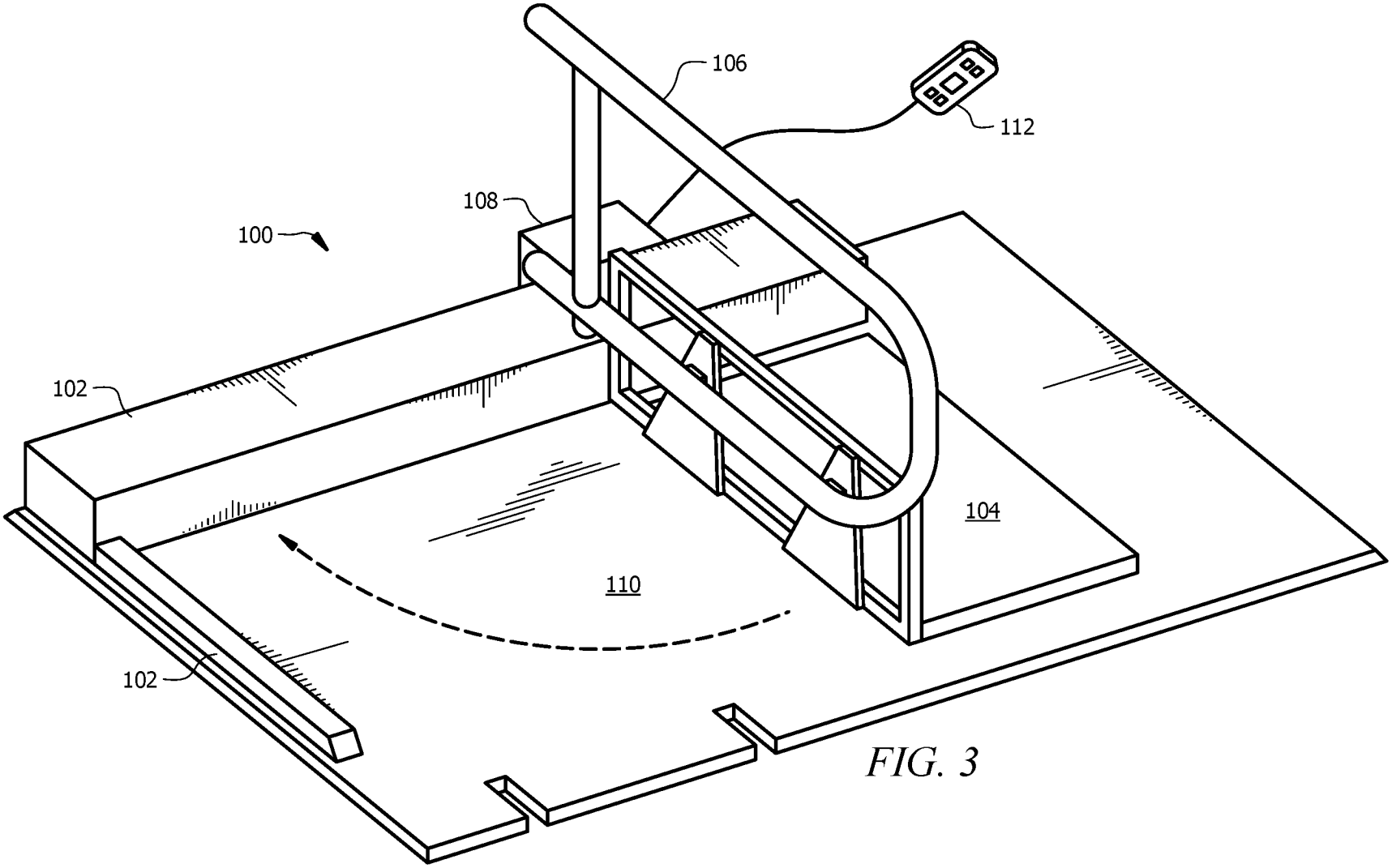
FIG. 3 is a perspective view of the embodiment of the personal mobility device in the second position.

FIGS. 1-3 are various views of a personal mobility device 100 in a first position (e.g., as shown in FIG. 1), transitioning from the first position to the second position (e.g., as shown in FIG. 2), and in the second position (e.g., as shown in FIG. 3). Turning now to FIG. 1, a perspective view of an embodiment of the personal mobility device 100 in the first position is shown. The personal mobility device 100 comprises a plurality of stabilizing members 102, a rotatable platform 104, a patient support member 106, a base plate 110, and, optionally, a motor 108 and a controller 112. Although illustrated in FIG. 1 and discussed below, it should be noted that the motor 108 and controller 112 are optional and may be omitted without departing from the scope of the present disclosure. Further, it should be noted that an orientation of the personal mobility device 100 may be determined as a matter of design choice. For example, to accommodate certain applications, the personal mobility device 100 may be mirrored horizontally with respect to the orientation illustrated in FIG. 1 without departing from the scope of the present disclosure. The stabilizing members 102 are arranged to create a stabilizing structure to provide support for the personal mobility device when the patient pulls on the patient support member 106 and/or stands on the rotatable platform 104, and are coupled to the base plate 110. For example, two stabilizing members 102 may be used and arranged perpendicularly such that the two stabilizing members together form an L-shaped structure on top of the base plate 110; however, a particular quantity and arrangement of the stabilizing members 102 may be determined as a matter of design choice and is not limited herein. Each of the stabilizing members 102 may be coupled to other stabilizing members 102, and to the base plate 110, using a removable coupling means such that a portion, or all, of the personal mobility device 100 may be disassembled to reduce a size of the personal mobility device 100 and make the personal mobility device 100 portable. The removable means may be, for example, a drop pin with or without a cotter pin, a bolt and nut, a clamping device, a frictional force based coupling, a suction cup, or any other suitable removable couplings. Each of the stabilizing members 102, the rotatable platform 104, the patient support member 106, and base plate 110 may be constructed of any suitable material capable of bearing forces resulting from any of the various embodiments as described in the present disclosure. For example, the material may be steel, stainless steel, a surgical or medical grade metal, aluminum, plastic, a composite, a material capable of sterilization, wood, combinations thereof, and/or any other suitable material as may be determined as a matter of design choice according to particular usage scenarios.

The rotatable platform 104 is pivotally coupled to the stabilizing members 102 such that the rotatable platform 104 is capable of rotating around the pivotal coupling to rotate the rotatable platform from a first position to a second position. As shown in FIG. 2, a range of motion of the rotatable platform around the pivotal coupling may be, for example, about 90 degrees; however, a particular degree of rotation may be determined as a matter of design choice and is not limited herein. The first position and the second position of the rotatable platform 104 may be located anywhere within the range of motion, but may be, for example about 0 degrees rotation for the first position as shown in FIG. 1, and about 90 degrees rotation for the second position as shown in FIG. 3. Returning now to FIG. 1, the rotatable platform 104 may be located at a minimum operable height with respect to the base plate 110 such that a bottom surface of the rotatable platform 104 touches or almost touches a top surface of the base plate 110 with and/or without the patient standing on the rotatable platform 104. To facilitate ease of motion, the bottom surface of the rotatable platform 104, and/or a portion of the top surface of the base plate 110, may be coated or covered with a material having a low coefficient of friction, for example, a polytetrafluoroethylene (PTFE) material such as that sold under the trademark TEFLON. Alternatively, one or more the rotatable platform 104 and/or the base plate 110 may comprise one or more rolling mechanism (e.g., ball bearings, casters, wheels, rollers, etc.) to facilitate ease of motion of the rotatable platform 104. Conversely, to prevent accidental slipping of the patient while standing on the rotatable platform 104, optionally, a top surface of the rotatable platform 104 may be coated with a material having a high coefficient of friction, for example, a non-slip material.

The patient support member 106 is coupled to the rotatable platform 104 such that the patient may use the patient support member 106 to pull himself into a standing position on the rotatable platform 104 and support a portion of his weight on the patient support member 106 while standing on the rotatable platform 104. To facilitate patients of various heights, the patient support member 106 may have an adjustable height. For example, the patient support member may comprise a plurality of members wherein at least a part of the members are configured to fit inside of other members. A first and a second of the plurality of members may be substantially vertical members that are coupled to the rotatable platform 104 and include at least one spring loaded push button on each of the first and the second vertical members. An outer member comprising two substantially vertical components corresponding to the first and the second member, and a coupling member between the two substantially vertical components, may have a plurality of vertically distributed holes in the two substantially vertical components such that the first member and the second member slide inside of the two substantially vertical components of the outer member and secure the outer member at a desired height when the spring loaded push buttons protrude through the holes of the outer member. Alternatively, each of the first member, the second member, and the outer member may have corresponding holes through which a locking mechanism, such as a pin or spring loaded button, is disposed to secure the outer member at the desired height. To provide a gripping surface, the patient support member 106 may be covered in a padded material, a non-slip material, or other coating that increases the safety and/or comfort of the patient support member 106.

The motor 108 is coupled to the stabilizing members 102 and the base plate 110 and configured to rotate the rotatable platform 104. However, in embodiments of the personal mobility device 100 in which the motor 108 is omitted, the rotatable platform 104 may be rotated manually by the caregiver. The motor 108 may be any motor suitable for rotating the rotatable platform 104 between the first position and the second position and may be determined as a matter of design choice and is not limited herein. For example, the motor 108 may be an about 120 volt (V) alternating current motor that is geared down such that the rotatable platform 104 rotates at a slow speed while maintaining a high level of power of the motor (e.g., allowing for use of the personal mobility device with patients of increased weight). The motor 108 may be geared down from about 1,750 revolutions per minute (RPM) to about 15 RPM using a gear ratio of about 9 on the side of the motor 108 to about 34 on the side of the rotatable platform 104. Alternatively, a direct current motor, a motor of a different voltage, a motor of a different RPM, and/or a different gear ratio may be used based on a desired level of performance or usage scenario for the personal mobility device 100. When present, the controller 112 is configured to control the motor 108 to rotate the rotatable platform 104. When the controller 112 is not present, the rotatable platform 104 may be rotated by the caregiver. The controller 112 may be a hardwired controller that communicates directly with the motor 108, a wireless controller that communicates wirelessly with the motor 108, an integrated controller that is built into the patient support member 106, or any combinations of the foregoing, for example, a wired or wireless controller 112 for a caregiver to use, and a built-in controller 112 in the patient support member 106 for the patient to use. When the personal mobility device 100 includes multiple controllers 112, one or more of the controllers 112 may be disabled for the safety of certain patients. For example, when the personal mobility device includes two controllers 112 (e.g., an integrated controller and a wired or wireless controller), the integrated controller may be selectively disabled at certain times for patient safety, and may be enabled at other times.

Figure 4:
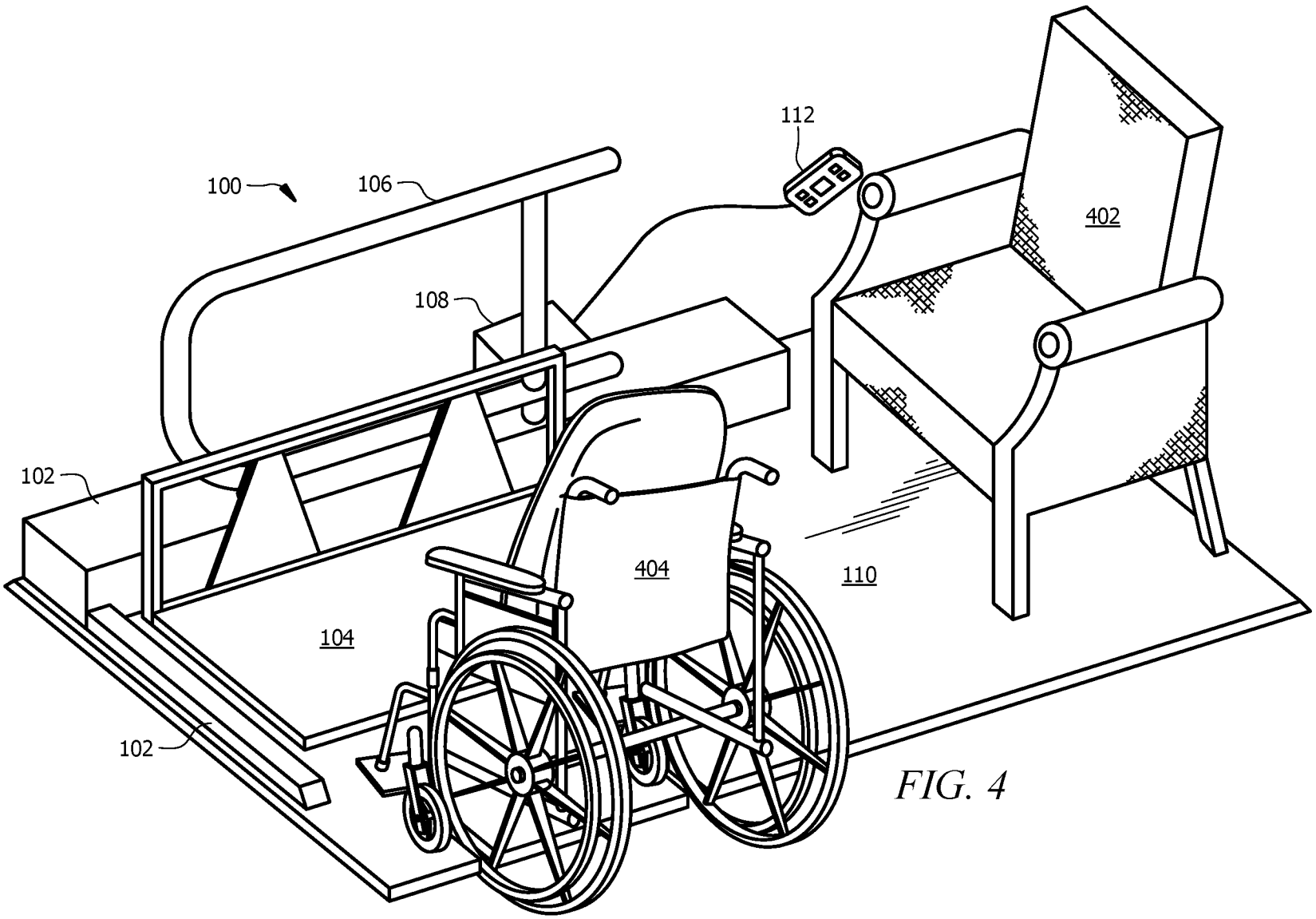
FIG. 4 is a perspective view of the embodiment of the personal mobility device illustrating a usage scenario.

FIG. 4 is a perspective view of the embodiment of the personal mobility device 100 illustrating a usage scenario. A patient sitting in a chair 402 may wish to transfer to a wheelchair 404, or alternatively, a patient sitting in the wheelchair 404 may wish to transfer to the chair 402. It should be noted that both the chair 402 and the wheelchair 404 are merely representative of locations in which the patient may be, or may desire to be, located. For example, the chair 402 and/or wheelchair 404 may each be a couch, a bed, a toilet, etc. without departing from the scope of the present disclosure. In addition, at least one of the chair 402 and the wheelchair 404 may be omitted when unnecessary. For example, if the patient wishes to transfer from one of the chair 402 or the wheelchair 404 into a standing position on the rotatable platform 104 to perform exercises, stretch, take part in physical rehabilitation, change clothing, for personal hygiene purposes, etc., only one of the chair 402 and the wheelchair 404 may be necessary and present during use of the personal mobility device 100.

Figure 5:
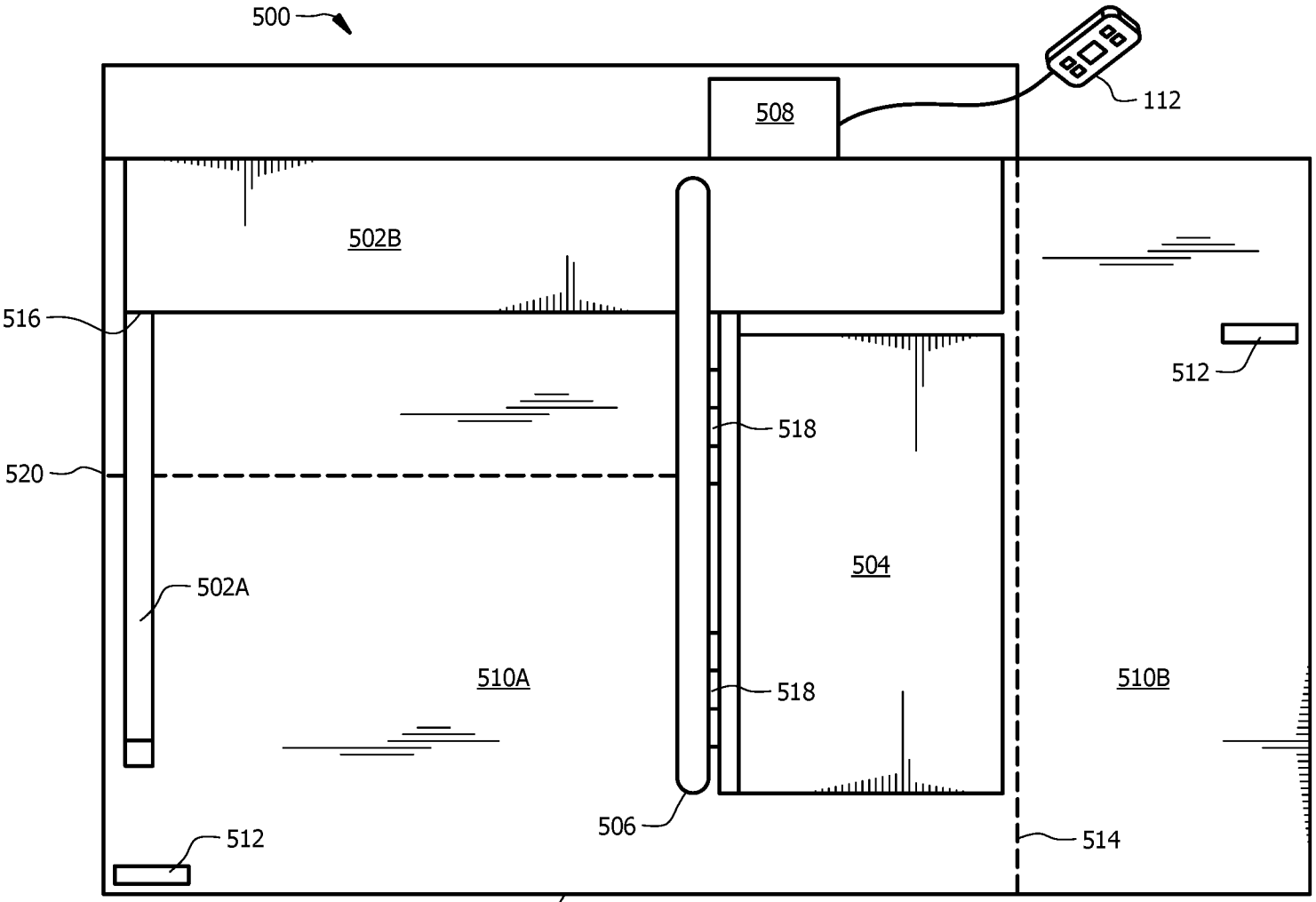
FIG. 5 is a top view of an embodiment of a transportable personal mobility device.

FIG. 5 is a top view of an embodiment of a transportable personal mobility device 500. The transportable personal mobility device 500 comprises a plurality of stabilizing members 502A and 502B, a rotatable platform 504, a patient support member 506, a base plate 510A, a base plate 510B, and, optionally, a motor 508 and a controller 112, each of which may be substantially similar to the personal mobility device 100. The transportable personal mobility device 500 is configured to facilitate transportation of the transportable personal mobility device 500 (e.g., by a caregiver) from one location to another location (e.g., from a room of one patient to a room of another patient, from a storage area to a room of a patient for physical rehabilitation, etc.). To facilitate ease of transportation, the transportable personal mobility device 500 is configured to be partially disassembled and/or reconfigured. For example, in one embodiment, the transportable personal mobility device 500 is configured to be reconfigured such that the transportable personal mobility device 500 may fit through a standard sized door. It should be noted that FIG. 5 and the following description illustrate merely one manner in which the transportable personal mobility device 500 may be partially disassembled and/or reconfigured to facilitate transportation and is not intended to be limiting. Alternative locations of disassembly or reconfiguration other than those illustrated in FIG. 5 and discussed below, but within the spirit of the foregoing and following discussions, are within the scope of the present disclosure.

To reconfigure the transportable personal mobility device 500, the stabilizing member 502A is uncoupled from the stabilizing member 502B at point 516. The stabilizing member 502A is then folded inward toward the stabilizing member 502B such that the stabilizing members 502A and 502B are parallel to each other. Additionally, if the stabilizing member 502A is coupled to the base plate 510A, such couplings may be uncoupled prior to folding the stabilizing member 502A to be parallel to the stabilizing member 502B.

After folding the stabilizing member 502A inward, the rotatable platform 504 is rotated inward into the first position so that the patient support member 506 is parallel to the stabilizing member 502B. The rotatable platform 504 is then folded upward at points 518 to be parallel to the patient support member 506 with respect to a vertical direction. The rotatable platform 504 may be folded upward by removing one or more positional locking mechanisms of the rotatable platform 504 at the points 518. For example, the rotatable platform 504 may be folded upward after removing locking and/or attachment pins at the points 518.

After rotating the rotatable platform 504 inward and folding the rotatable platform 504 upward, the base plate 510B is detached from the base plate 510A along the line 514. Optionally, a storage structure (e.g., a slide rack) may be built into the transportable personal mobility device 500 for storing the base plate 510B after the base plate 510B is detached from the base plate 510A. Further, each of the base plate 510A and the base plate 510B may comprise one or more handles 512 to facilitate ease of movement. After the base plate 510B is detached from the base plate 510A, the base plate 510A is folded upward along the line 520. To facilitate folding the base plate 510A upward along the line 520 the base plate 510A may comprise a plurality of individual base plate pieces coupled together along the line 520 using one or more hinges. Optionally, the base plate 510A may comprise a plurality of wheels configured such that the transportable personal mobility device 500 may be transported by rolling on the wheels after partial disassembly and/or reconfiguration. The wheels may be configured such that they do not engage the ground until the transportable personal mobility device 500 is lifted and tipped in a certain direction, until a lever is pulled or depressed, until a locking mechanism is disengaged, and/or any other suitable means for selectively engaging the ground with wheels of the transportable personal mobility device 500 for transporting the transportable personal mobility device 500 from a first location to a second location.

Figure 6:
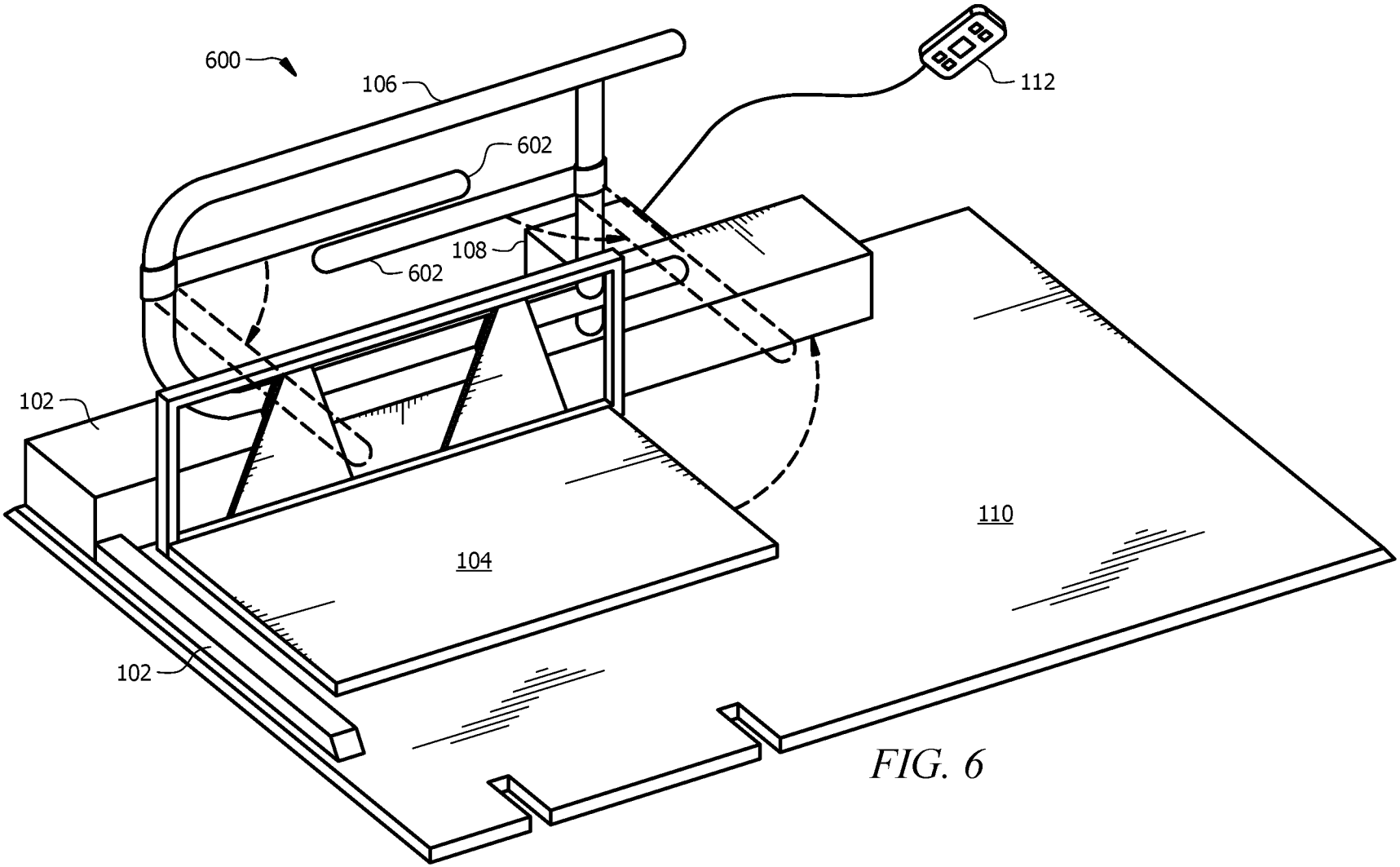
FIG. 6 is a perspective view of an embodiment of the personal mobility device with sidearm attachments.

FIG. 6 is a perspective view of an embodiment of the personal mobility device 600 with sidearm attachments 602. The personal mobility device 600 may be substantially similar to the personal mobility device 100. In certain circumstances, a patient standing on a rotatable platform 104 may desire additional options for supporting his weight other than a patient support member 106. To provide additional support options for the patient, the personal mobility device 600 comprises a plurality of sidearm attachments 602 configured to rotate from a position parallel to the patient support member 106 to a position perpendicular to the patient support member 106. The sidearm attachments 602 are coupled to the patient support member 106 such that, when rotated to be perpendicular to the patient support member 106, the sidearm attachments 602 are located to the left side, to the right side, or to both sides of a patient standing on the rotatable platform 104 and facing the patient support member 106. The sidearm attachments 602 are configured to rotate from the position parallel to the patient support member 106 to the position perpendicular to the patient support member 106 through rotation in an arc toward the patient standing on the rotatable platform 104 (e.g., by rotating in an arc of about 90 degrees), or through rotation in an arc away from the patient standing on the rotatable platform 104 (e.g., by rotating in an arc of about 270 degrees). The sidearm attachments 602 may comprise a securing mechanism to secure the sidearm attachments 602 in one or more positions with respect to the patient support member 106. For example, the sidearm attachments 602 may be securable in a position parallel to the patient support member 106, a position perpendicular to the patient support member 106, or both.

The sidearm attachments 602 may be tubular members having a circular cross section, or alternatively, may have a square cross section, a rectangular cross section, or any other suitable cross section for supporting a portion of the patient's weight. Additionally, a padded and/or gripping surface may be coupled to at least a portion of the sidearm attachments 602. In one embodiment, the sidearm attachments 602 may be an integrated component of the patient support member 106 such that the sidearm attachments 602 are permanently attached to the personal mobility device 600. In an alternative embodiment, the sidearm attachments 602 may be coupled to the patient support member 106, for example, as an add-on attachment. As one example, the sidearm attachments 602 may be removably coupled to the patient support member 106 using a clamping mechanism. Alternatively, the sidearm attachments 602 may be coupled to the patient support member 106 through welding, bolting, or any other suitable means. The sidearm attachments 602 may be constructed of any suitable material capable of bearing forces resulting from supporting a portion of the patient's weight as described in the present disclosure. For example, the material may be steel, stainless steel, a surgical or medical grade metal, aluminum, plastic, a composite, a material capable of sterilization, wood, combinations thereof, and/or any other suitable material as may be determined as a matter of design choice according to particular usage scenarios.

Figure 7:
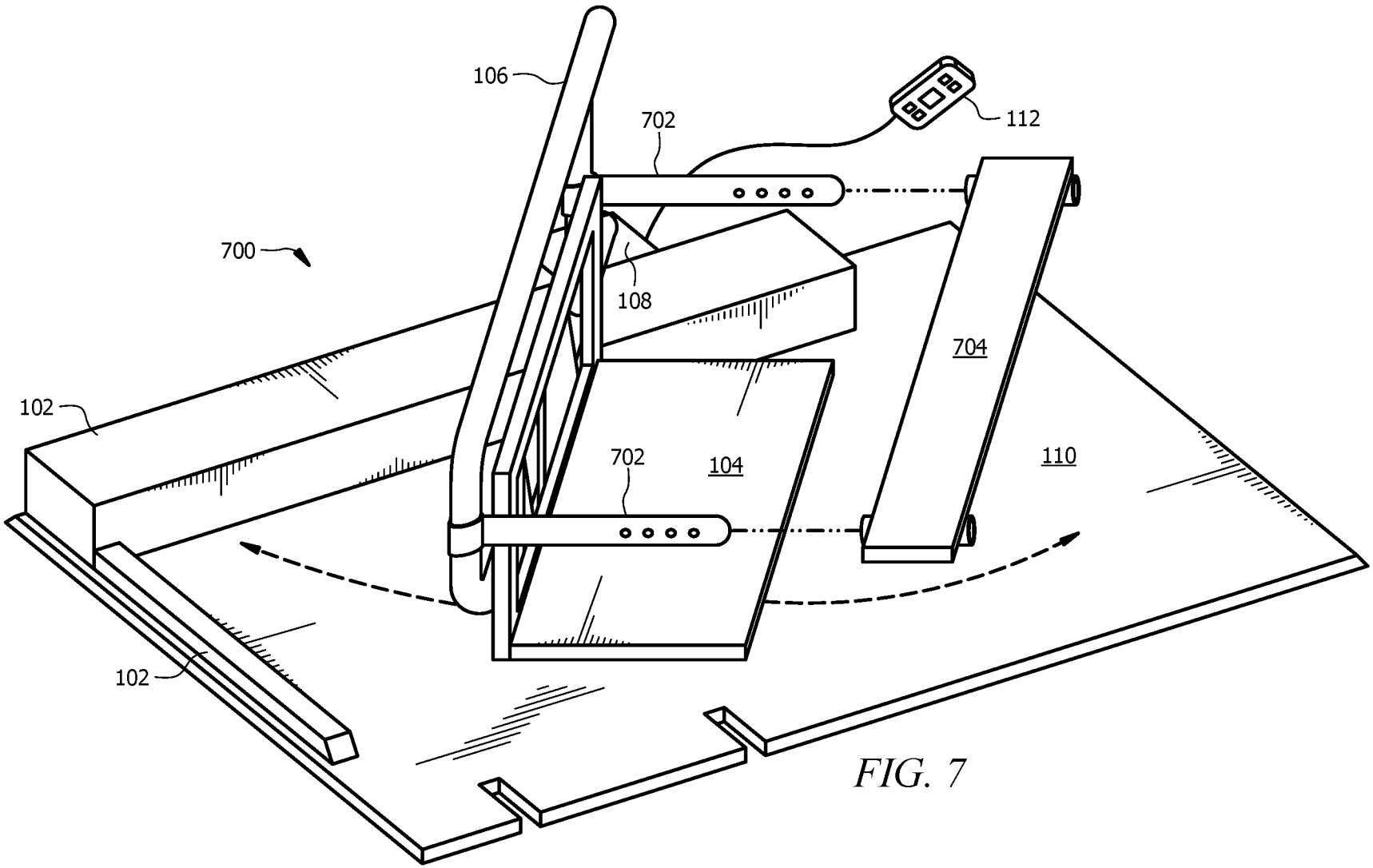
FIG. 7 is a perspective view of an embodiment of the personal mobility device with the sidearm attachments and a seat attachment.

FIG. 7 is a perspective view of an embodiment of the personal mobility device 700 with the sidearm attachments 704 and a seat attachment 706. The personal mobility device 700 may be substantially similar to the personal mobility device 100, and the side arm attachments 704 may be substantially similar to the sidearm attachments 602. The seat attachment 704 comprises a substantially flat surface configured to mount to the sidearm attachments 702 when the sidearm attachments 702 are rotated to be perpendicular to the patient support member 106. The flat surface may be rectangular, circular, elliptical, or any other suitable shape that allows for a patient to sit on the flat surface. The flat surface may be constructed of any suitable material capable of bearing forces resulting from the patient sitting on the seat attachment 704 as described in the present disclosure. For example, the material may be steel, stainless steel, a surgical or medical grade metal, aluminum, plastic, a composite, a material capable of sterilization, wood, combinations thereof, and/or any other suitable material as may be determined as a matter of design choice according to particular usage scenarios.

Optionally, the seat attachment further comprises a back coupled to the flat surface. A padded surface may be coupled to at least a portion of a top face of the flat surface and/or a front face of the back. The seat attachment 704 further comprises a plurality of mounting brackets coupled to a bottom face of the flat surface and configured to interface with the sidearm attachments 702. For example, the mounting brackets may be U-shaped brackets that surround at least a portion of a cross section of the sidearm attachments 702 to secure the seat attachment 704 to the sidearm attachments 702. The mounting brackets may secure the seat attachment 704 to the sidearm attachments 702 using pins, screws, bolts, a frictional fit/force, a ratcheting mechanism, a freewheel mechanism, spring-loaded pins, and/or any other suitable mechanism that prevents the seat attachment 704 from sliding off of the sidearm attachments 702 unless desired. Alternatively, the mounting brackets may comprise a clamping mechanism configured to clamp the seat attachment 704 to the sidearm attachments 702.

Figure 8:
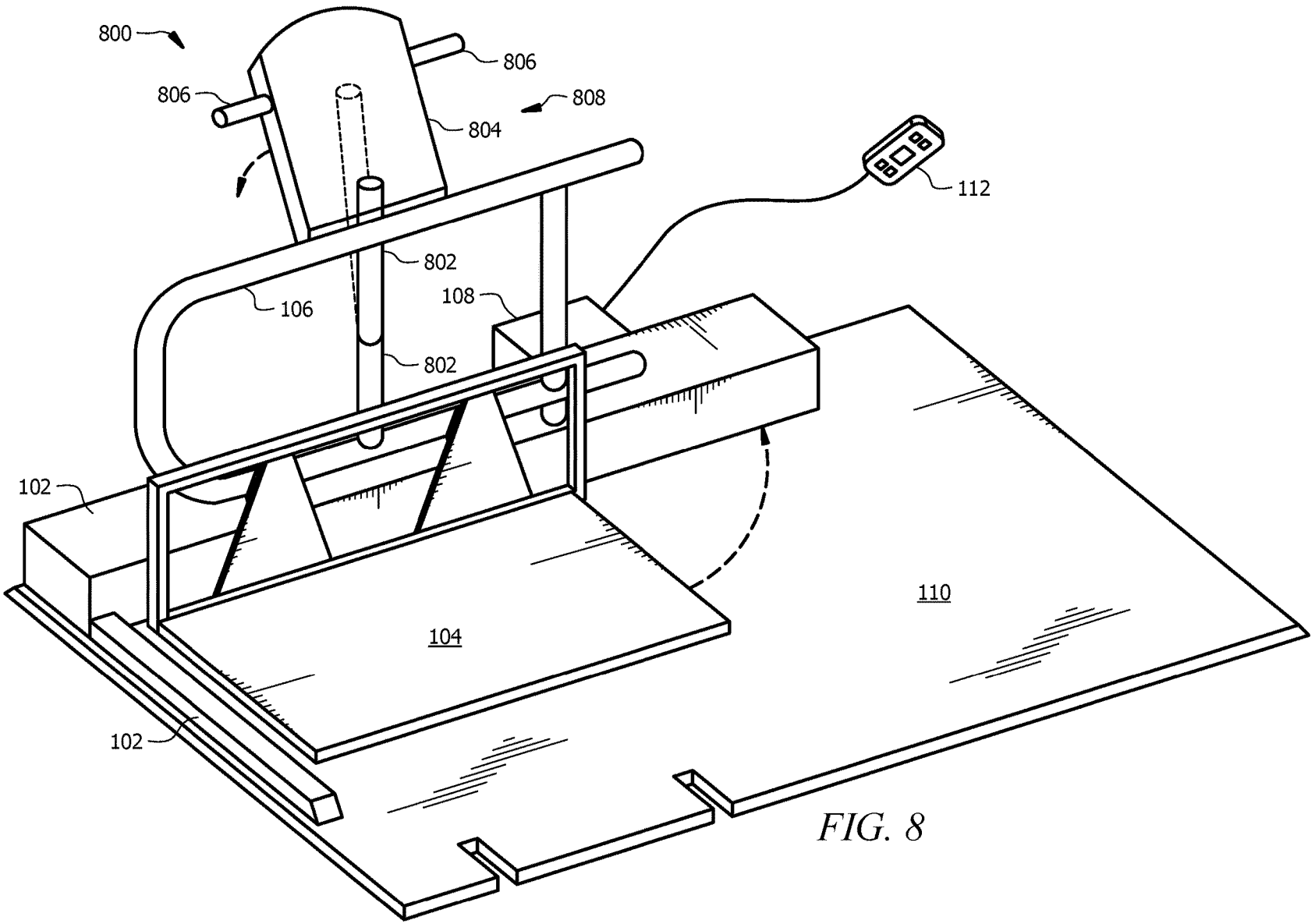
FIG. 8 is a perspective view of an embodiment of the personal mobility device with a body support attachment.

FIG. 8 is a perspective view of an embodiment of the personal mobility device 800 with a body support attachment 808. The personal mobility device 800 may be substantially similar to the personal mobility device 100 and may, optionally, include sidearm attachments (e.g., the sidearm attachments 602 or 702) and/or a seat attachment (e.g., the seat attachment 704). The body support attachment 808 is configured to enable a patient standing on the rotatable platform 104 to support at least a portion of the patient's weight on the body support attachment 808. For example, the patient may lie forward over the patient support member 106 such that an upper body of the patient (e.g., the patient's torso) rests against the body support attachment 808. The body support attachment 808 comprises a plurality of vertical support members 802, a body board 804, and optionally, one or more handles 806. The support members 802 are coupled to the patient support members 106 and/or the rotatable platform at a first end and are coupled to the body board 804 at a second end. Additionally, one or more support members 802 may be used to couple one support member 802 to another support member 802. The body board 804 comprises a substantially flat surface configured to receive the portion of the patient's weight. Optionally, the body board 804 may further comprise padding located on a patient-facing surface of the body board 804. The body board 804 may have any suitable shape for supporting a portion of the patient's weight, but may be, for example, a rectangle, a rectangle with one or more rounded corners, an oval, etc. Further, the body board 804 may be constructed of any material suitable for supporting the patient's weight and suited for a particular usage scenario (e.g., surgical grade metals, composites, wood, melamine, resin, and/or combinations thereof). When the body support attachment 808 comprises the handles 806, the handles 806 are coupled to a left side and a right side of the body board 804.

To facilitate use with patients of varying heights and to support varying amounts of the patient's weight, the body support attachment 808 may be positionally adjustable such that an angle of the body board 804 changes with respect to the patient support member 106. For example, the body support attachment 808 may be configured such that adjusting an arrangement of at least some of the plurality of vertical support members 802 adjusts the position of the body board 804. In one embodiment, a desired position of the body board 804 is obtained by adjusting the support members 802 such that a first of the support members slides with respect to a second of the support members, thereby adjusting the angle of the body board 804 with respect to the patient support member 106. The support members 802 and the body board 804 may be held in the desired position by a spring-based tension mechanism, a locking mechanism (e.g., a spring-loaded pin, a bolt, a lock, or other suitable securing device), or any other suitable mechanism. For example, the support members 802 may be configured similar to a support mechanism for an ironing board.

Figure 9:
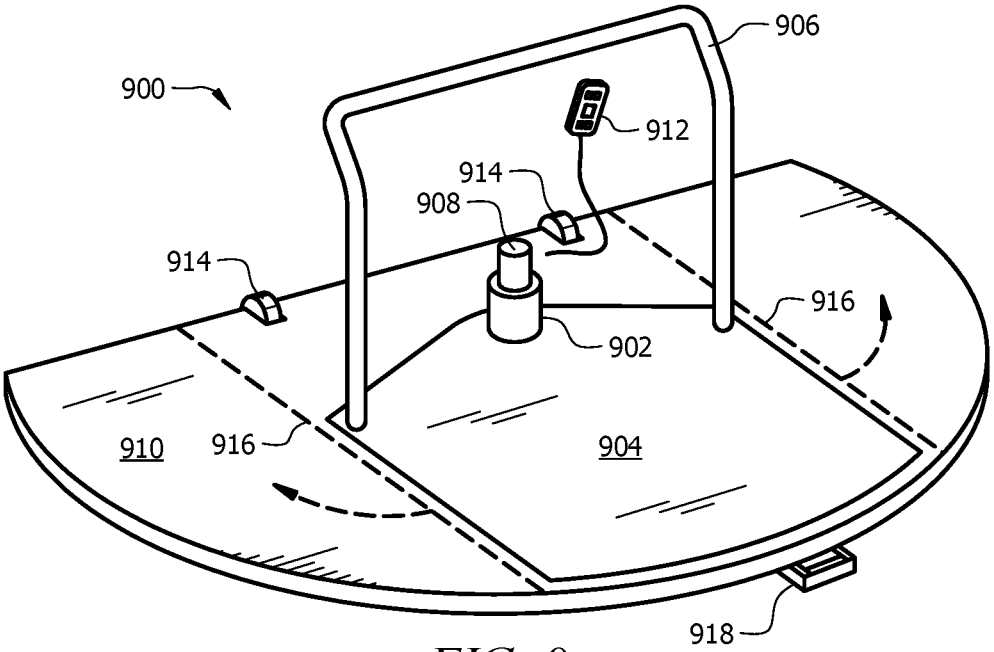
FIG. 9 is a perspective view of another embodiment of a personal mobility device.

FIG. 9 is a perspective view of another embodiment of a personal mobility device 900. The personal mobility device 900 comprises a support column 902, a rotatable platform 904, a patient support bar 906, a base plate 910, and, optionally, a motor 908 and a controller 912. Although illustrated in FIG. 9 and discussed below, it should be noted that the motor 908 is optional and may be omitted without departing from the scope of the present disclosure. In one embodiment, the base plate 910 is a substantially circular structure defined by the remainder of a circle after having a circular segment removed such that the base plate 910 is capable of abutting a substantially flat vertical structure (e.g., a wall). Particular endpoints of a chord used to define the circular segment, and thereby an arc of the chord and dimensions of the base plate 910, may be a matter of design choice, but in one embodiment, may be selected such that the rotatable platform 904 has a range of motion supported by the base plate 910 of about 180 degrees. Alternatively, the base plate 910 may be any suitable size and shape for supporting the rotatable platform 904.

The support column 902 is coupled to the base plate 910 to provide a point around which the rotatable platform 904 rotates. In one embodiment, the support column 902 is coupled to the base plate 910 at a center point of the base plate 910. As used herein, the center point of the base plate 910 refers to the center point of the substantially circular structure with the circular segment included (e.g., a complete circle). Alternatively, the support column 902 may be coupled to the base plate 910 at any suitable location that allows the rotatable platform 904 to rotate about the support column 902 while being supported by the base plate 910.

The rotatable platform 904 includes a plurality of wheels configured such that the rotatable platform rotates about the support column 902 when pushed and/or pulled. The wheels may have a fixed position and be configured to roll in a single dimension such that the rotatable platform 904 rotates about the support column 902 in a predetermined arc. Alternatively, the wheels may move in a plurality of dimensions and be, for example, casters having a swiveling means of coupling to the rotatable platform 904. To facilitate ease of motion, the bottom surface of the rotatable platform 904, and/or a portion of the top surface of the base plate 910, may be coated or covered with a material having a low coefficient of friction, for example, a PTFE material such as that sold under the trademark TEFLON. Conversely, to prevent accidental slipping of the patient while standing on the rotatable platform 904, optionally, a top surface of the rotatable platform 904 may be coated with a material having a high coefficient of friction, for example, a non-slip material.

The patient support member 906 is coupled to the rotatable platform 904 such that the patient may use the patient support member 906 to pull himself into a standing position on the rotatable platform 904 and support a portion of his weight on the patient support member 906 while standing on the rotatable platform 904. To provide a gripping surface, the patient support member 906 may be covered in a padded material, a non-slip material, or other coating that increases the safety and/or comfort of the patient support member 906. To facilitate patients of various heights, the patient support member 906 may have an adjustable height, for example, as discussed above with respect to the patient support member 106 and not repeated again herein.

The motor 908 is coupled to the stabilizing column 902 and configured to rotate the rotatable platform 904. However, in embodiments of the personal mobility device 900 in which the motor 908 is omitted, the rotatable platform 904 may be rotated manually by the caregiver. The motor 908 may be any motor suitable for rotating the rotatable platform 904 and may be determined as a matter of design choice and is not limited herein. For example, the motor 908 may have similar characteristics to the motor 108, which is discussed above and not repeated herein. When present, the controller 912 is configured to control the motor 908 to rotate the rotatable platform 904. When the controller 912 is not present, the rotatable platform 904 may be rotated by the caregiver. The controller 912 may be any suitable controller, for example, a hardwired controller, a wireless controller, an integrated controller, or combinations thereof, and may be substantially similar to the controller 112.

Optionally, the personal mobility device 900 may be configured to interface with one or more attachments. For example, the personal mobility device may be configured to interface with the sidearm attachments 604, the seat attachment 704, and/or the body support attachment 808, each of which is described above and not repeated herein. When the personal mobility device 900 is configured to interface with the body support attachment 808, the patient support member 906 may be modified to add one or more cross members to provide support for the body support attachment 808. Further optionally, the personal mobility device 900 may be comprise a handle 918 coupled to the base plate 910 and the base plate 910 may be reconfigurable about reference lines 916 (e.g., pivotally reconfigurable via one or more hinges).

Figure 10:
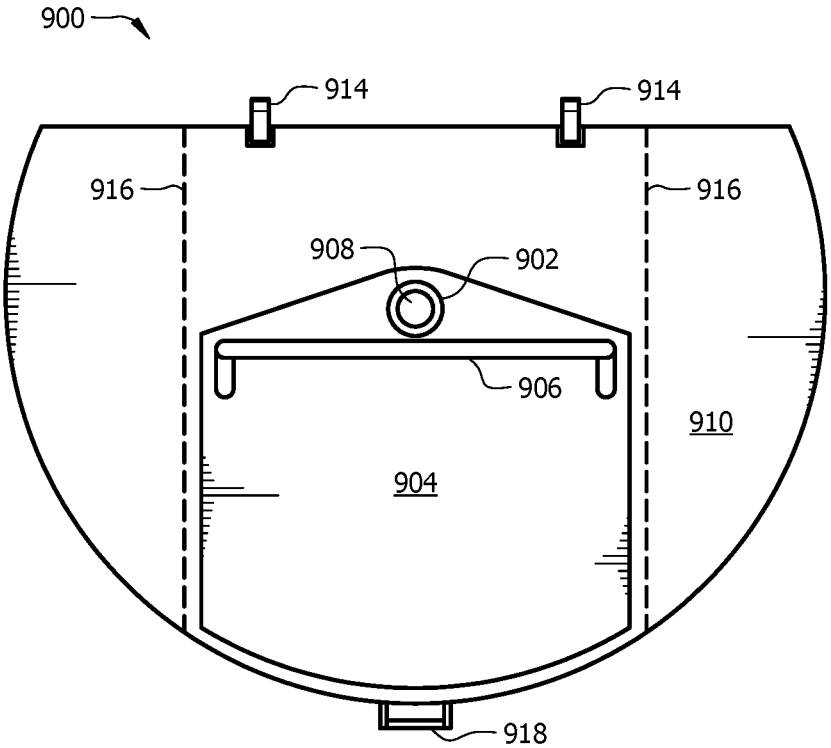
FIG. 10 is a top view of another embodiment of a personal mobility device.

FIG. 10 is a top view of the personal mobility device 900. The personal mobility device 900 comprises the support column 902, the rotatable platform 904, the patient support member 906, the base plate 910, and, optionally, the motor 908 and a controller (not shown), each of which may function substantially similar to manner describer above with respect to FIG. 9, which is not repeated again herein. The personal mobility device 900 is configured to facilitate transportation of the personal mobility device 900 (e.g., by a caregiver) from one location to another location (e.g., from a room of one patient to a room of another patient, from a storage area to a room of a patient, such as for in-room physical rehabilitation, etc.). To facilitate ease of transportation, the personal mobility device 900 is configured to be partially disassembled and/or reconfigured to enable the personal mobility device 900 to fit through a standard sized door and be transportable by a single caregiver. For example, in one embodiment, the base plate 910 is configured to be folded in a plurality of locations to reduce a size of the personal mobility device 900. It should be noted that FIG. 10 and the following description illustrate merely one manner in which the personal mobility device 900 may be partially disassembled and/or reconfigured to facilitate transportation and is not intended to be limiting. Alternative locations of disassembly or reconfiguration other than those illustrated in FIG. 9 and discussed below, but within the spirit of the foregoing and following discussions, are within the scope of the present disclosure.

Optionally, to facilitate transportation of the personal mobility device 900, the personal mobility device 900 may comprise a plurality of wheels 914 configured such that the personal mobility device 900 may be transported tilting the personal mobility device 900 onto the wheels 914 and rolling the personal mobility device 900 on the wheels 914. The wheels 914 may be configured such that they do not engage the ground until the personal mobility device 900 is lifted and tipped in a certain direction and/or at a certain angle, until a lever is pulled or depressed, until a locking mechanism is disengaged, and/or any other suitable means for selectively engaging the ground with wheels 914 for transporting the personal mobility device 1000 from a first location to a second location.

Further, the personal mobility device 900 may comprise at least one handle 918 for lifting the personal mobility device 900 and controlling the personal mobility device 1000 during transportation from the first location to the second location. In one embodiment, the handle 918 is coupled to the base plate 910 and protrudes from the base plate 910. In an alternative embodiment, the handle 918 may be integrated into the base plate 910, for example, the handle 918 may be formed by a void in the base plate 910.

To reconfigure the personal mobility device 900 for transportation, the base plate 910 may be folded upward along the lines 916 such that at least a portion of the base plate is in a substantially vertical position parallel to the support column 902 and perpendicular to the rotatable platform 904. To facilitate folding the base plate 910 upward along the lines 916, the base plate 910 may comprise a plurality of individual base plate pieces coupled together along the lines 916 using one or more hinges. The folded portions of the base plate 910 may be secured in the substantially vertical position by a securing mechanism to prevent accidental dropping during transportation of the personal mobility device 900. Optionally, to further reduce the size of the personal mobility device 900 for transportation, the patient support member 906 may be folded downward from a position perpendicular to the rotatable platform 904 to a position parallel to the rotatable platform 904. For example, the patient support member 906 may be folded downward to lie on top of the rotatable platform 904.

Figure 11:
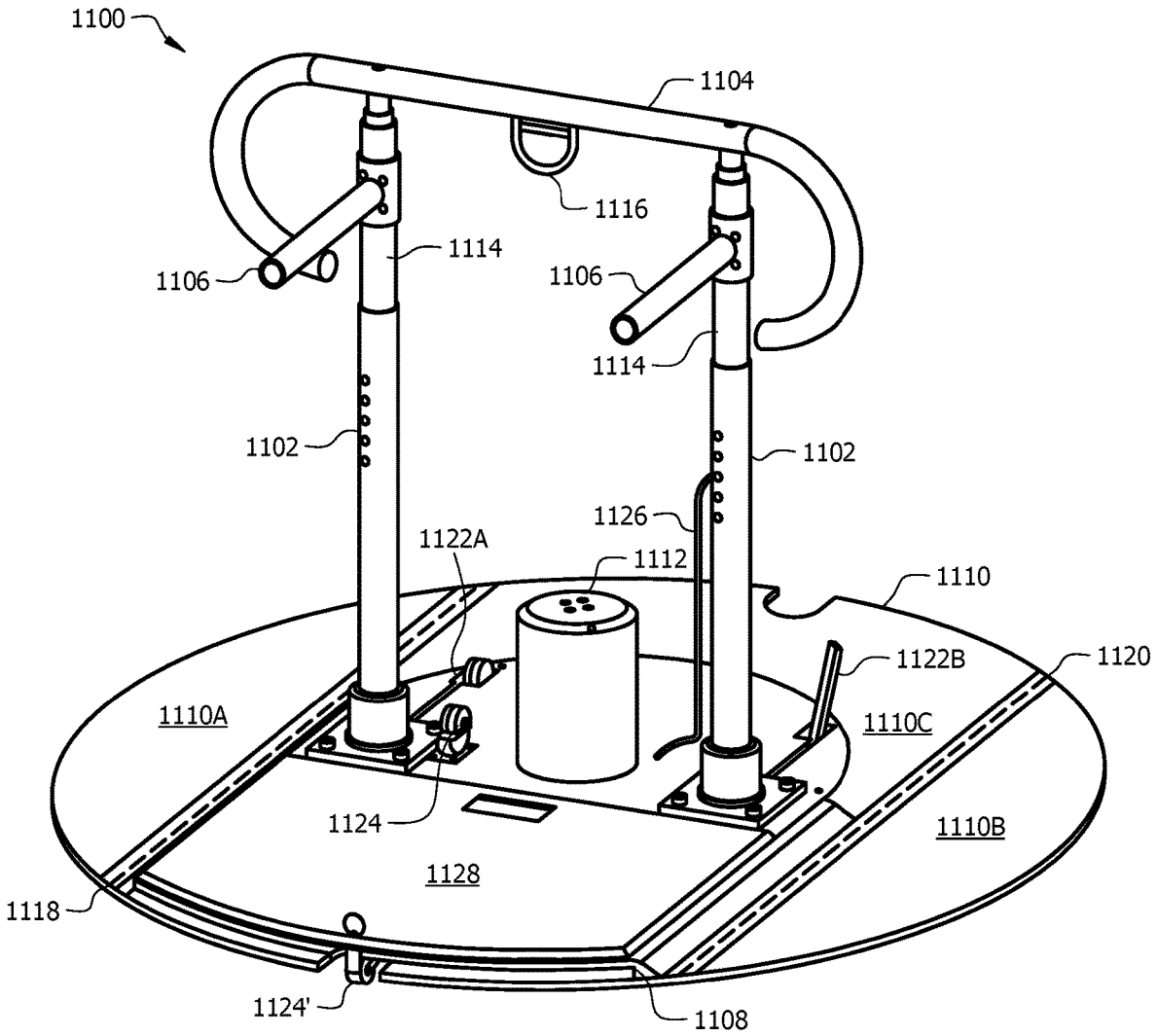
FIG. 11 is a perspective view of another embodiment of a personal mobility device.

FIG. 11 is a perspective view of another embodiment of a personal mobility device 1100. The personal mobility device 1100 may be configured to aid in effecting a movement of a patient from a first position to a second position (e.g., from a seated position to a standing position, from a first seated position at a first location to a second seated position at a second location, etc.). The personal mobility device 1100 may be further configured to aid in providing of services to a patient (e.g., by a caregiver such as in a hospital, assisted living environment, or nursing home, an in-home caregiver, etc.). The services may include, for example, physical rehabilitation, bathing, exercising, changing of clothing, physical examination, and the like. The personal mobility device 1100 may be configured in some embodiments as a stationary device, and in other embodiments may be configured to be transportable from a first location to a second location (e.g., from a storage location to a patient location, from a room or location of a first patient to a room or location of a second patient, etc.).

The personal mobility device 1100 comprises a plurality of vertical support members 1102, a patient support bar 1104, a plurality of arms 1106, a rotating platform 1108, a base plate 1110, and a motor 1112. The plurality of vertical support members 1102 and the patient support bar 1104, in some embodiments, may be referred to as a support structure. The rotating platform 1108 may be configured to receive a patient such that the patient may stand directly or indirectly on a top surface of the rotating platform 1108. The rotating platform 1108 may be further configured to interface with the base plate 1110 such that the rotating platform 1108 may rotate about approximately a center point of the base plate 1110 via a plurality of rollers coupled to the rotating platform 1108 and configured to support the rotating platform 1108 on a top surface of the base plate 1110. The plurality of rollers may rotate along one or more axis. For example, the plurality of rollers may each be mounted on a horizontal axis such that each roller may only roll in a forward or backward direction (as determined with respect to each respective roller of the plurality of rollers), or the plurality of rollers may be configured to allow movement in a plurality of direction (forward, backward, and sideways as determined with respect to each respective roller of the plurality of rollers). The plurality of rollers may be coupled to, and distributed on, an underneath side of the rotating platform 1108 such that the rotating platform 1108 rests on the top surface of the base plate 1110 via at least some of the plurality of rollers. At a given point in time, any one or more of the plurality of rollers may be in contact with the base plate 1110, though not all of the plurality of rollers may be in contact with the base plate 1110 together at a given time, or at all times generally. The plurality of rollers may be distributed on the underneath side of the rotating platform 1108 in any suitable orientation to provide support for the rotating platform 1108, for example, when a patient is standing on the rotating platform 1108 and/or the rotating platform 1108 is rotating. A quantity of the plurality of rollers and a particular placement of the plurality of rollers on the underneath side of the rotating platform 1108 may be a matter of design choice (e.g., as determined according to a desired maximum load that may be carried by the rotating platform 1108, cost, complexity, etc.) and is not limited herein. The rotating platform may be configured to rotate any desired amount between 0 and 360 degrees, for example, to effect movement of the patient from the first position to the second position, or to position the rotating platform to receive a patient from a seated position. Additionally, the rotating platform 1108 may have a size determined such that the rotating platform 1108 may be not greater in size that a central portion 1110C of the base plate 1110, as discussed below.

The rotating platform 1108 may be coupled to the motor 1112 to facilitate the rotation of the rotating platform 1108. The motor 1112 may also be coupled to the base plate 1110 at approximately the center point of the base plate 1110 to facilitate and/or perform the rotation of the rotating platform 1108. The motor 1112 may be any motor suitable for rotating the rotating platform 1108 on top of, and about approximately a center point of, the base plate 1110. For example, in some embodiments the motor 1112 may be a high torque, low speed motor. The motor 1112 may be controlled via a wired controller, a wireless controller, a controller integrated into another portion of the personal mobility device 1100 (e.g., foot-based controls, controls in the plurality of vertical support members 1102, the patient support bar 1104, and/or the plurality of arms 1106, etc.), or any other suitable means which is not limited herein.

The plurality of vertical support members 1102 may be coupled to the rotating platform 1108 and configured to interface with the patient support bat 1104, extension arms, and/or the arms 1106 to enable a patient to, for example and without limitation, transfer from a seated position to a standing position on the rotating platform 1108 and/or support at least a portion of the patient's weight while standing on the rotating platform 1108. Each of the plurality of vertical support members 1102 may be a tubular structure configured to receive the extension arms 1114. While illustrated as being substantially straight, the extensions arms 1114 may be s-shaped such that the extensions arms 1114 may be closer to, or farther from, a patient standing on the rotating platform 1108 than the plurality of vertical support members 1102 (and correspondingly, straight shaped extension arms 1114), or may be any other suitable shape that may achieve the functions described herein. Each of the plurality of vertical support members 1102 may include a plurality of holes configured to couple the plurality of vertical support members 1102 to other components (e.g., the extension arms 1114 and/or other components or accessories as discussed below). For example, each of the plurality of vertical support members 1102 may include a plurality of holes configured to receive spring buttons that may be coupled to each of the extensions arms 1114. The extensions arms 1114 may be positioned and held in place in the plurality of vertical support members 1102 via the spring buttons interfacing with the holes. As such, a height of the extension arms 1114 may be determined, at least in part, by which one or more of the plurality of holes of the plurality of each of the plurality of vertical support members 1102 are utilized to interface with the spring buttons of the extension arms 1114. Alternatively, both the plurality of vertical support members 1102 and the extensions arms 1114 may include holes through which other means enable the extensions arms 1114 to be positioned and held in place in the plurality of vertical support members 1102 (e.g., threaded holes for receiving a threaded rod, holes for receiving a pin, etc.).

The arms 1106 may be configured to couple to the plurality of vertical support members 1102 and/or the extension arms 1114. The arms 1106 may couple to the plurality of vertical support members 1102 and/or the extension arms 1114 via one or more spring buttons, as discussed above. The arms 1106 may be configured to be repositionable such that one or more spring buttons of the arms 1106 are depressed, the arms 1106 may be repositioned (e.g., one or more of the arms 1106 may be rotated to be parallel to the patient support bar 1104 and/or one or more of the arms 1106 may be rotated to be perpendicular to the patient support bar 1104).

The patient support bar 1104 may couple to the plurality of vertical support members 1102, in some embodiments, via the extension arms 1114. As such, a height of the patient support bar 1104 may be determined, at least in part, based on a height of the extension arms, as discussed above. In other embodiments, the patient support bar 1104 may couple to the plurality of vertical support members 1102 without the use of the extensions arms 1114. The patient support bar 1104 may be configured to span an opening between the plurality of vertical support members 1102 to create a substantially horizontal support which may be used by a patient to, for example, transfer from a seated position to a standing position on the rotating platform 1108 and/or support at least a portion of the patient's weight while standing on the rotating platform 1108. The patient support bar 1104 may extend beyond one or more of the plurality of vertical support members 1102. For example, as shown in FIG. 11, in some embodiments the patient support bar 1104 may include curved portions at one or both ends of the patient support bar 1104. In other embodiments, the patient support bar 1104 may include curved portions at one or both ends of the patient support bar 1104 in any suitable shape or orientation that may achieve the functions described herein. In some embodiments, the patient support bar 1104 may further include a coupler 1116 configured to couple a safety device to the patient support bar 1104. For example, in some embodiments the coupler 1116 may be a d-ring coupled to an underside of the patient support bar 1104 to enable a patient standing on the rotating platform 1108 to be attached to the patient support bar 1104 via the coupler 1116. In such embodiments, the patient may be attached to the patient support bar 1104 via the coupler 1116 by coupling a belt or other apparatus worn by, or secured to, the patient to the coupler 1116, for example, by a carabiner or similar style means of coupling.

The base plate 1110 may be a substantially circular structure configured to support and provide stability for the personal mobility device 1100. In some embodiments it may be desirable for the base plate 1110 to have a relatively large footprint (e.g., overall amount of floor space occupied by the base plate 1110 and correspondingly the personal mobility device 1100) for a high level of stability and such that, in at least some embodiments, the rotating platform 1108 is at all times supported by at least a portion of the base plate 1110. In some embodiments it may also be desirable to transport the personal mobility device 1100 from one location to another location, for example, by passing through one or more doorways or other passageways which may have limited space. As such, the base plate 1110 may comprise a plurality of portions coupled together via an articulable means (e.g., one or more hinges). For example, the base plate may comprise a plurality of portions configured to fold to reduce the footprint of the base plate 1110 (and correspondingly the personal mobility device 1100). In some embodiments, the base plate 1110 may comprise three portions, a first side portion 1110A, a second side portion 1110B, and a central portion 1110C. The first side portion 1110A may be coupled to the central portion 1110C via a first hinge 1118 and the second side portion 1110B may be coupled to the central portion 1110C via a second hinge 1120. Each of the first hinge 1118 and the second hinge 1120 may extend any suitable length along a side of the first side portion 1110A, the second side portion 1110B, and/or the central portion 1110C, and may comprise any number of portions (e.g., the first hinge 1118 and the second hinge 1120 may each be a single hinge or may comprise a plurality of hinges distributed along the side of the first side portion 1110A, the second side portion 1110B, and/or the central portion 1110C). The first side portion 1110A and the second side portion 1110B may be configured to pivot upwards along the first hinge 1118 and the second hinge 1120, respectively, to reduce the footprint of the base plate 1110 to approximately a footprint of the central portion 1110C to enable the personal mobility device 1100 to be transported from a first location to a second location.

Accordingly, in some embodiments the central portion 1110C may have a width (as measured between the first hinge 1118 and the second hinge 1120) suitable for transportation through doorways and/or passageways (e.g., in some embodiments the central portion 1110C may have a width of approximately 30 inches to enable the personal mobility device 1100 to be transported through interior doorways conforming to a 32 inch standard). The first side portion 1110A and the second side portion 1110B may be configured to pivot to a predefined location (e.g., until one or both of the first side portion 1110A and/or the second side portion 1110B may rest against one or more of the plurality of vertical support members 1102) or may be configured to lock or be otherwise secured at a certain position. For example, in some embodiments, any one or more of the plurality of vertical support members 1102, the first side portion 1110A, and/or the second side portion 1110B may include couplings that may enable one or more of the first side portion 1110A and/or the second side portion 1110B to be secured (e.g., via a chain, cord, carabiner or similar style means of coupling, etc.) to one or more of the plurality of vertical support members 1102.

The base plate 1110 may further include one or more features that may enable transportation of the personal mobility device 1100 from a first location to a second location. For example, the base plate 1110 may include one or more cutouts that may enable one or more wheels coupled to the base plate 1110 to engage the ground on demand (e.g., when engaged by a caregiver who wishes to move the personal mobility device from the first location to the second location) such that the personal mobility device 1100 may be supported by at least some of the wheels when the wheels are engaged and may be supported by at least a portion of the base plate 1110 when the wheels are not engaged.

To further enable transportation of the personal mobility device 1100 from a first location to a second location, the personal mobility device 1100 may comprise a plurality of wheels of any one or more styles. For example, the personal mobility device may include levered wheels 1122A and 1122B. The levered wheels 1122A and 1122B may be coupled to the base plate 1110 (e.g., the central portion 1110C of the base plate 1110) and configured to pivot about a coupling point between the levered wheels 1122A and 1122B and the base plate 1110 when the levered wheels 1122A and 1122B are engaged. For example, the levered wheel 1122A is illustrated in FIG. 11 in a disengaged position in which the levered wheel 1122A may be located when the personal mobility device is in use or is not being transported from the first location to the second location. The levered wheel 1122B is illustrated in FIG. 11 in an engaged position in which the levered wheel 1122B may be located when the personal mobility device is not in use and is configured for transportation, or is being transported, between the first location and the second location. The levered wheels 1122A and 1122B may be engaged or disengaged by raising or lowering, respectively, the lever of the levered wheels 1122A and 1122B. Engaging or disengaging the levered wheels 1122A and 1122B may cause the levered wheels 1122A and 1122B to extend, or withdraw, through the at least some of the one or more cutouts of the base plate 1110 as discussed above.

The personal mobility device 1100 may additionally comprise at least one repositionable wheel 1124. The repositionable wheel 1124 may be stored on a surface of the personal mobility device 1100 (e.g., on an upper surface of the rotating platform 1108) when the personal mobility device is in use or is not being transported from the first location to the second location. When the personal mobility device is not in use and is configured for transportation, or is being transported, between the first location and the second location, the repositionable wheel 1124 may be repositioned into a position indicated by 1124' and coupled to one of the base plate 1110 or the rotating platform 1108. For example, the repositionable wheel 1124 may be repositioned to the position 1124' by sliding the repositionable wheel 1124 into a slot of the base plate 1110 or the rotating platform 1108 and securing the repositionable wheel 1124 in place with a pin or other suitable securing mechanism. To aid in sliding the repositionable wheel 1124 into a slot of the base plate 1110 or the rotating platform 1108, the personal mobility device 1100 may further comprise a lifting aid 1126 which may be operable by a caregiver as a lever to lift the personal mobility device to enable the caregiver to slide the repositionable wheel 1124 into a slot of the base plate 1110 or the rotating platform 1108. The lifting aid 1126 may be detachably coupled to one of the plurality of vertical support members 1102 when not in use and may be detached by a caregiver when the caregiver wishes to utilize the lifting aid 1126 and reattached when the caregiver no longer wishes to utilize the lifting aid 1126. The lifting aid 1126 may be made of any suitable material including, but not limited to, aluminum, steel, wood, a plastic, or any other material suitable for the purposes described above.

The personal mobility device 1100 may be configured to interface with one or more accessories which may increase a level of safety and/or functionality of the personal mobility device 1100. For example, in some embodiments the personal mobility device 1100 may additionally comprise one or more safety straps (not shown) which may span between and be coupled to the plurality of vertical support members 1102. For example, the one or more safety straps may inhibit an ability of a patient standing on the rotating platform 1108 to fall between the plurality of vertical support members 1102. In some embodiments, the personal mobility device 1100 may be configured to interface with a body board (not shown) that may be substantially similar to body board 804, discussed above, and may be configured to couple to detachably couple to the personal mobility device 1100. In some embodiments, the personal mobility device 1100 may be further configured to interface with other accessories such as a detachable or positionable table surface, a seat, additional arms or leverage points for use by a patient in transferring from a seated position to a standing position on the rotating platform 1108 and/or supporting at least a portion of the patient's weight while standing on the rotating platform 1108, a pole for mounting medical supplies (e.g., a intravenous therapy bag and/or medical equipment such as monitors, sensors, etc.), an alarm to indicate that a patient may have fallen from the rotating platform 1108, and other such accessories which may enhance a level of safety and/or functionality of the personal mobility device 1100. In some embodiments, the personal mobility device 1100 may further comprise a scale 1128 coupled to a top surface of the rotating platform 1108 such that a patient standing on the personal mobility device 1100 may be located on the scale 1128 rather than directly on the rotating platform 1108. The scale may be battery powered, powered by the motor 1112, powered by a same power source as supplies the motor 1112, or may have an independent power source.

The use of the term "about" in the present disclosure means a range including ±10% of the subsequent number, unless otherwise stated. While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

What is claimed is:

1. A personal mobility device comprising:

a base plate having a top surface and a bottom surface and comprising a central portion, a first side portion coupled to the central portion via a first articulable coupling, and a second side portion coupled to the central portion via a second articulable coupling, wherein a majority of the bottom surface of the base plate is configured to contact a surface on which the personal mobility device is located when the personal mobility device is in use by a user, and wherein a surface area of the bottom surface of the base plate is substantially equal to an area consumed by a physical footprint of the personal mobility device;

a rotating platform having a top surface and a bottom surface, wherein the rotating platform has a smaller physical footprint than a surface engaged by the bottom surface of the rotating platform for support, wherein a plurality of rollers are coupled to the bottom surface of the rotating platform and configured to support the rotating platform upon the top surface of the base plate, wherein the rotating platform is positioned over only the central portion when in a first position and the personal mobility device is in use by the user, and wherein the rotating platform is positioned over both the central portion and one of the first side portion or the second side portion when the rotating platform is rotated ninety degrees from the first position when the personal mobility device is in use by the user;

a motor coupled to the base plate and the rotating platform and configured to rotate the rotating platform with respect to the base plate; and a support structure coupled to the rotating platform and extending upward from the top surface of the rotating platform.

2. The personal mobility device of claim 1, wherein the motor rotates the rotating platform 360 degrees.

3. The personal mobility device of claim 1, wherein the support structure comprises:

a plurality of vertical support members; and a patient support bar coupled to the plurality of vertical support members.

4. The personal mobility device of claim 3, further comprising an arm coupled to the support structure, wherein the arm is positionable in at least a first position parallel to the patient support bar and at least a second position perpendicular to the patient support bar.

5. The personal mobility device of claim 1, further comprising a scale removably coupled to the top surface of the rotating platform.

6. The personal mobility device of claim 1, further comprising a plurality of wheels coupled to the base plate and configured to be selectively engaged to support the personal mobility device for transportation from a first location to a second location, wherein at least some of the plurality of wheels move from a first position that is not in contact with a floor to a second position that is in contact with the floor when the plurality of wheels are selectively engaged, and wherein at least some of the plurality of wheels raise the base plate to an elevated position off of the floor when the plurality of wheels are selectively engaged.

7. An apparatus comprising:

a base plate having a top surface and a bottom surface and comprising a central portion, a first side portion coupled to the central portion via a first articulable coupling, and a second side portion coupled to the central portion via a second articulable coupling, wherein a majority of the bottom surface of the base plate is configured to contact a surface on which the personal mobility device is located when the apparatus is in use by a person, and wherein a surface area of the bottom surface of the base plate is substantially equal to an area consumed by a physical footprint of the apparatus;

a rotating platform pivotally coupled to the base plate via a pivotal coupling, the rotating platform having a top surface and a bottom surface, wherein the rotating platform has a smaller physical footprint than a surface engaged by the bottom surface of the rotating platform for support, wherein the rotating platform is positioned over only the central portion when in a first position and the personal mobility device is in use by the user, and wherein the rotating platform is positioned over both the central portion and one of the first side portion or the second side portion when the rotating platform is rotated ninety degrees from the first position when the personal mobility device is in use by the user; and a support structure coupled to the rotating platform, wherein the support structure is configured to assist in supporting the person standing on the rotating platform, and wherein the rotating platform is configured to be rotated about the pivotal coupling from a first position to a second position.

8. The apparatus of claim 7, further comprising a motor, wherein the rotating platform is pivotally coupled to the base plate via the motor.

9. The apparatus of claim 8, wherein the motor rotates the rotating platform about approximately a center point of the base plate.

10. The apparatus of claim 7, wherein the support structure comprises:

a plurality of vertical support members;

a plurality of extensions adjustably coupled to the plurality of vertical support members; and a support bar coupled to the plurality of extensions, and wherein a height of the support structure with respect to the rotating platform is adjustable according to the adjustable coupling between the plurality of vertical support members and the plurality of extensions.

11. The apparatus of claim 7, further comprising a plurality of wheels coupled to the base plate to enable transportation of the apparatus from the first location to the second location, wherein at least some of the plurality of wheels are selectively engageable to move from a first position that is not in contact with a floor to a second position that is in contact with the floor, and wherein at least some of the plurality of wheels raise the base plate to an elevated position off of the floor when the plurality of wheels are selectively engaged.

12. The apparatus of claim 7, wherein the base plate is a circular shape, and wherein the first position and the second position are located within a 180 degree range.

13. An apparatus comprising:

a base plate having a top surface and a bottom surface and comprising a central portion, a first side portion coupled to the central portion via a first articulable coupling, and a second side portion coupled to the central portion via a second articulable coupling, wherein a majority of the bottom surface of the base plate is configured to contact a surface on which the apparatus is located when the apparatus is in use by a person, wherein a surface area of the bottom surface of the base plate is substantially equal to an area consumed by a physical footprint of the apparatus, and wherein the base plate is positioned beneath the rotating platform and configured to support the rotating platform, and wherein the baseplate comprises a plurality of repositionable portions;

a rotating platform having a top surface and a bottom surface, wherein the rotating platform has a smaller physical footprint than a surface engaged by the bottom surface of the rotating platform for support, wherein the rotating platform is positioned over only the central portion when in a first position and the personal mobility device is in use by the user, and wherein the rotating platform is positioned over both the central portion and one of the first side portion or the second side portion when the rotating platform is rotated ninety degrees from the first position when the personal mobility device is in use by the user; and a support structure coupled to the rotating platform, wherein the rotating platform is configured to rotate in a circular motion to transport a person standing on the rotating platform from a first location to a second location, and wherein the support structure is configured to be usable by the person as a brace and leverage point for rising from a sitting position to stand on the rotating platform and supporting at least a portion of a weight of the person.

14. The apparatus of claim 13, further comprising a plurality of wheels, wherein the plurality of wheels are positioned such that the rotating platform is supported on the base plate by the plurality of wheels.

15. The apparatus of claim 13, further comprising a motor coupled to the rotating platform and the base plate and configured to rotate the rotating platform with respect to the base plate.

16. The apparatus of claim 13, wherein the support structure comprises:

a plurality of vertical support members extending perpendicularly from the rotating platform;

a plurality of extensions adjustably coupled to the plurality of vertical support members; and a support bar coupled to the plurality of extensions, and wherein a height of the support structure with respect to the rotating platform is adjustable according to the adjustable coupling between the plurality of vertical support members and the plurality of extensions.

17. The apparatus of claim 13, further comprising a plurality of selectively engageable wheels configured to support the apparatus to enable transportation of the apparatus from a first location to a second location, wherein at least some of the plurality of selectively engageable wheels move from a first position that is not in contact with a floor to a second position that is in contact with the floor when the plurality of selectively engageable wheels are selectively engaged, and wherein at least some of the plurality of selectively engageable wheels raise the apparatus to an elevated position off of the floor when the plurality of selectively engageable wheels are selectively engaged.

* * * * *